US005292117A

United States Patent [19]

Takagi et al.

[11] Patent Number: 5,292,117

[45] Date of Patent: Mar. 8, 1994

[54] IMAGE FORMING APPARATUS HAVING SHEET CASSETTE HAVING LATERAL GUIDES

[75] Inventors: Kazuhiko Takagi; Eiji Yokota, both of Nagoya, Japan

[73] Assignee: Brother Kogyo Kabushiki Kaisha, Aichi, Japan

[21] Appl. No.: 936,619

[22] Filed: Aug. 27, 1992

[30] Foreign Application Priority Data

Sep. 13, 1991 [JP] Japan ..... 3-234771

[51] Int. Cl.[5] ..... B65H 9/00

[52] U.S. Cl. ..... 271/234; 271/248; 271/253; 271/171; 271/127

[58] Field of Search ..... 271/127, 145, 160, 171, 271/234, 240, 248, 253

[56] References Cited

U.S. PATENT DOCUMENTS 4,221,375 9/1980 Morrison et al. ..... 271/160 X
4,395,034 7/1983 Fukui .
5,078,380 1/1992 Kitazawa ..... 271/127 X

FOREIGN PATENT DOCUMENTS 0287915 10/1988 European Pat. Off. .
186528 8/1991 Japan .
1206717 9/1970 United Kingdom .

OTHER PUBLICATIONS

Patent Abstracts of Japan vol. 10 No. 25 (M-450)(2082) Jan. 31, 1986 & JP-A-60 183 438 (RICOH) Sep. 18, 1985.

Patent Abstracts of Japan vol. no, No. 291 (M-522)(2347) Oct. 3, 1986 & JP-A-61 106 341 (Matsushita Electric Co) May 24, 1986.

*Primary Examiner*—D. Glenn Dayoan
*Assistant Examiner*—Boris Milef
*Attorney, Agent, or Firm*—Kane, Dalsimer, Sullivan, Kurucz, Levy, Eisele and Richard

[57] ABSTRACT

A sheet feed cassette capable of preventing a sheet of a sheet stack from diagonal feeding when the sheet is delivered out of the cassette. The sheet feed cassette has sheet guides at lateral sides thereof whose inner surfaces serve as sheet guide surfaces. In the sheet guide, box like portions are provided. In the box-like portions, sub-guides are provided protrudable from upper ends of the sheet guides. The sub-guides have sub-guide surfaces flush with the guide surfaces of the sheet guides. Each lateral side edge of the sheet is abuttable with each of the sub-guide surfaces if the sheet is positioned above the upper ends of the sheet guides for guiding the sheet in a sheet feeding direction. Thus, the diagonal travel of the sheet can be obviated by the sub-guides.

9 Claims, 8 Drawing Sheets

IMAGE FORMING APPARATUS HAVING SHEET CASSETTE HAVING LATERAL GUIDES

BACKGROUND OF THE INVENTION

The present invention relates to an image forming apparatus having a sheet cassette. More particularly, the invention relates to such sheet feed cassette which stores therein a stack of a plurality of sheets for supplying each one of sheets to an image forming section of an image forming apparatus with avoiding diagonal sheet feeding.

A conventional sheet feed cassette of this kind is provided in an image forming apparatus such as a printer and a copying machine etc., for storing therein a stack of a plurality of sheets. The printer is provided with sheet supplying roller for feeding out, one by one, an uppermost sheet of the sheet stack stored in the sheet feed cassette. Within the sheet feed cassette, sheet lifter plate is provided for bringing the sheet stack into contact with the sheet supplying roller when the sheet cassette is attached to the printer. Further, within the sheet feed cassette, sheet guides are provided at lateral sides thereof, so that lateral side edges of the sheets are in contact therewith for the purpose of guiding the sheet in a sheet feeding direction directing toward a printing section.

However, if sheets are voluminously stacked to a height approximately equal to the upper edge of the sheet guide in the sheet feed cassette, and such cassette is assembled into the printer, the upper sheet(s) of the sheet stack may exceed over the upper edge of the sheet guide due to the movement of the sheet lifter toward the sheet supplying roller. If sheet feed out operation is carried out with such a state by the sheet supplying roller, the upper sheet may not undergo guiding by the sheet guides. Therefore, diagonal sheet feeding may occur. Such diagonal sheet feeding may cause sheet jamming, and largely degrade printing quality.

SUMMARY OF THE INVENTION

The present invention has been made to overcome the above described drawback, and it is an object of the invention to provide a sheet feed cassette capable of preventing the sheet from diagonal feeding when the sheet is delivered out of the sheet feed cassette toward a printing section.

This and other objects of the present invention will be attained by providing a sheet feed cassette used in an image forming apparatus for storing a stack of a plurality of sheets and for delivering each one of the sheets to a desired position in a sheet feeding direction, the cassette comprising (a) a sheet guide unit having a guide surface for guiding movement of the sheet in the sheet feeding direction, lateral side edges of the sheet being abuttable on the guide surface, the sheet guide unit having an upper end, and (b) a sub-guide unit protrudable to a position above the upper end of the sheet guide unit for guiding movement, in the sheet feeding direction, of an upper portion of the sheet stack, the upper portion being positioned above the upper end of the sheet guide unit.

In the sheet feed cassette thus constructed, the sheet positioned above the upper edge of the sheet guide unit can abuts the sub-guide unit at lateral side edges of the sheet. Thus the sub-guide can guide travel of the sheet in the sheet feeding direction.

In another aspect of the invention there is provided an image forming apparatus for forming an image on a sheet comprising a main body portion provided with an image forming section, a sheet cassette, sheet supplying means, sheet feeding means, sheet guide means, and biasing means. The sheet cassette is detachably provided to the main body portion for storing therein a stack of a plurality of cut sheets and for supplying the sheet to the image forming section in a sheet feeding direction. The sheet cassette includes a sheet guide unit and a sub-guide unit. The sheet guide unit has a guide surface for guiding movement of the sheet in the sheet feeding direction. Lateral side edges of the sheet are abuttable on the guide surface. The sub-guide unit is protrudable to a position above the upper end of the sheet guide unit for guiding movement, in the sheet feeding direction, of an upper portion of the sheet stack, the upper portion being positioned above the upper end of the sheet guide unit. The sheet supplying means is adapted for supplying each one of the sheets from the sheet cassette in the sheet feeding direction. The sheet feeding means is adapted for feeding the sheet supplied by the sheet supplying means to the image forming section. The sheet feeding means includes a first sheet feed roller rotatably supported by the main body portion, and a second sheet feed roller supported by the sheet cassette at a position confrontable with the first sheet feed roller when the sheet cassette is fully attached to the main body portion. The sheet guide means includes first and second guide plates provided at the main body portion for defining a sheet feed passage bridging between the sheet feeding means and the image forming section. The first guide plate is pivotally movable in a state of detachment of the sheet cassette from the main body portion for providing an open space at the sheet feed passage. The biasing means is provided in the sheet cassette for urging the second roller toward the first roller when the sheet cassette is attached to the main body portion.

DETAILED DESCRIPTION OF THE PREFERRED EMBODIMENTS

Figure 1:
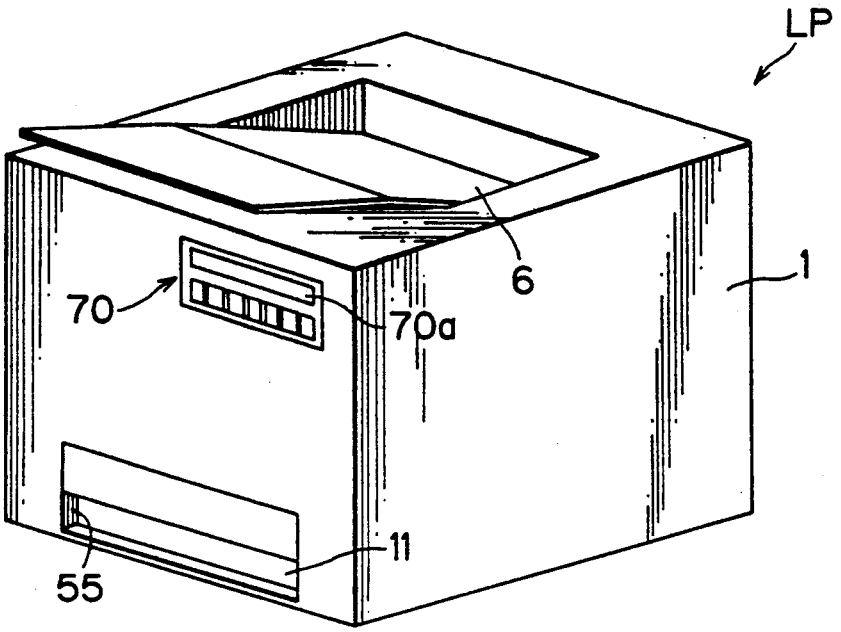
FIG. 1 is a perspective view showing a laser printer according to one embodiment of the present invention.

An image forming apparatus according to one embodiment of the present invention will be described with reference to FIGS. 1 through 10. According to the depicted embodiment, the present invention is applied to a laser printer which performs printing operation based on print data transmitted from an external equipment such as a personal computer and a work station. Throughout the specification, the expressions "front", "rear", "above", "below" and "laterally" are used herein to define the various parts when the printer is disposed in an orientation in which it is intended to be used.

A laser printer LP will be briefly described. The laser printer is of an ordinary type and has a main frame 1 in which are provided a laser scanner unit (not shown), a process cartridge 2 (see FIG. 2), a transfer/separation unit having a transfer charger and a eraser needle (not shown), a fixing unit having a heat roller and a pressure roller (not shown), and a sheet feed unit having a supply roller, a resist roller 3, a feed roller and a discharge roller. Further, a manipulation panel 70 having a display portion 70 is provided in the laser printer LP. The display portion 70 is adapted to display an error message such as sheet jamming.

Figure 2:
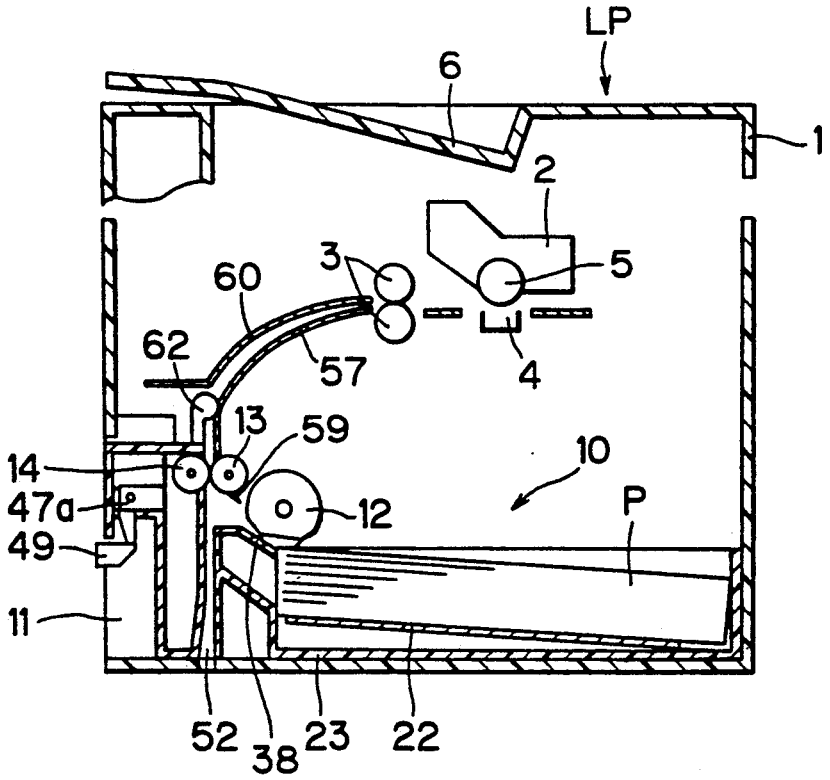
FIG. 2 is a schematic cross-sectional view showing an internal arrangement of the laser printer.

The process cartridge 2 will be described with reference to FIG. 2. A peripheral surface of a photosensitive drum 5 is provided with an electrostatic latent image by the laser scanner unit and through an application of a high voltage from a charger 4. The electrostatic latent image becomes a visible image by toners supplied thereto. The developed image is transferred to a sheet P supplied from a sheet feed mechanism 10 in synchronism with the rotation of the photosensitive drum 5. Thereafter, the sheet P is passed through the fixing unit and is discharged onto a discharge tray 6.

Next, will be described with reference to FIGS. 2 through 9, the sheet feed mechanism 10 provided in the main frame 1 of the laser printer LP.

The sheet feed mechanism 10 generally includes a sheet cassette 11 storing therein a plurality of sheets P, a sheet supplying roller 12 for supplying a sheet P in the sheet cassette 11 toward the process cartridge 2, a pair of first and second feed rollers 13 and 14, and a drive motor (not shown) for drivingly rotating the sheet supplying roller 12 and the first feed roller 13.

Figure 4:
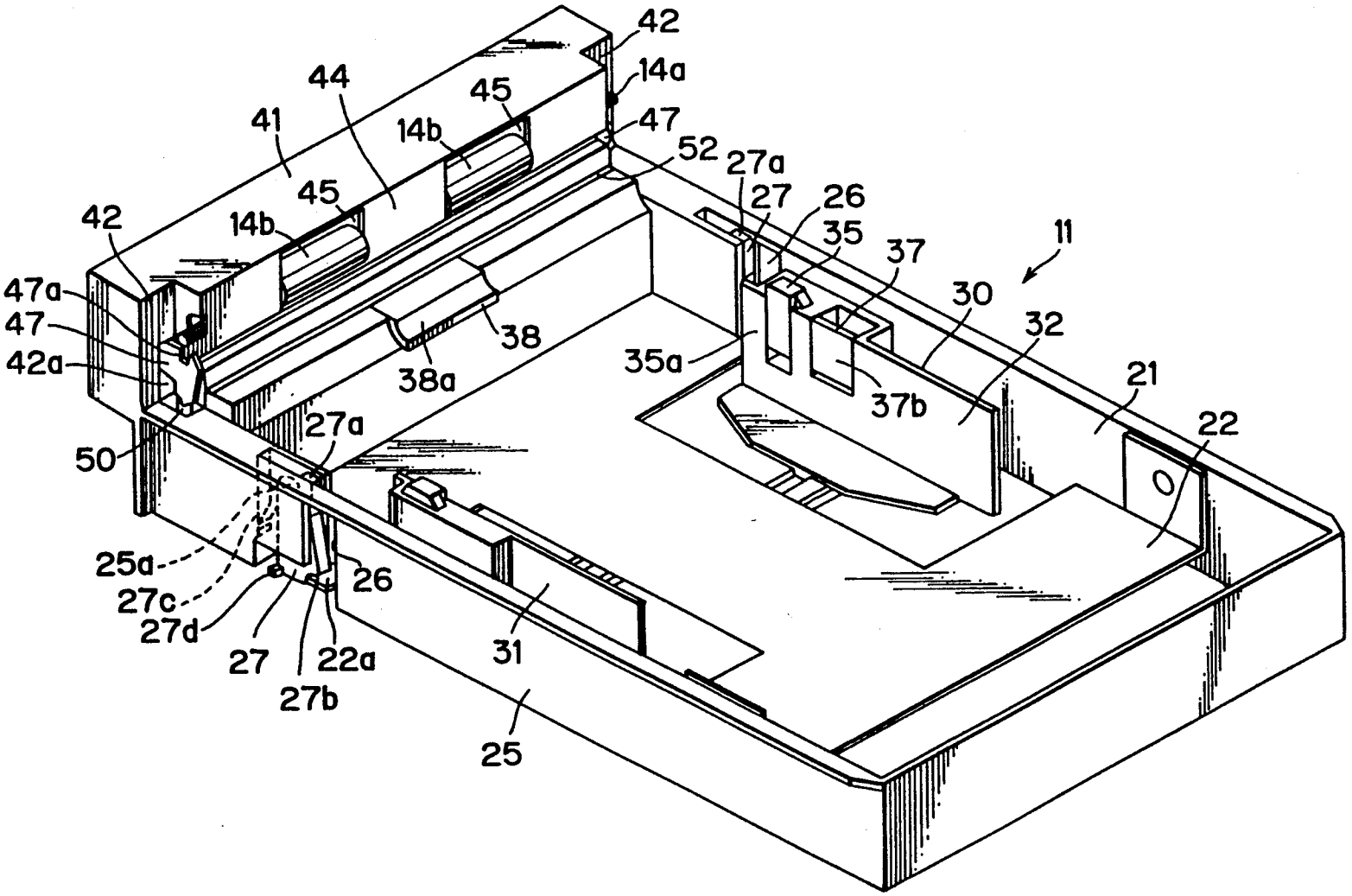
FIG. 4 is a perspective view showing the sheet cassette.
Figure 5:
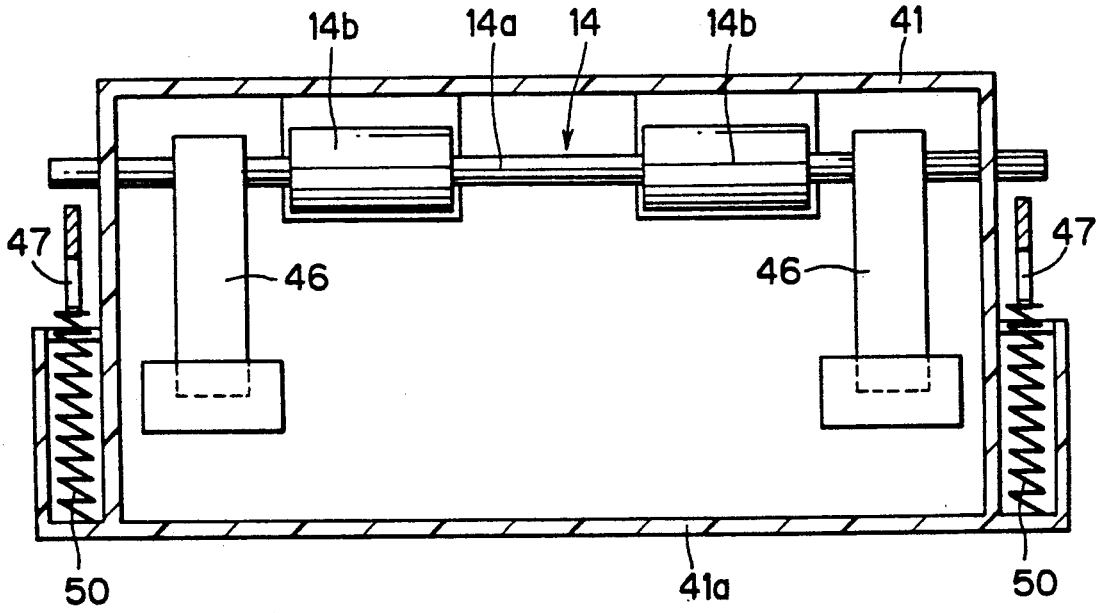
FIG. 5 is a cross-sectional view showing a grip portion of the sheet cassette.
Figure 8:
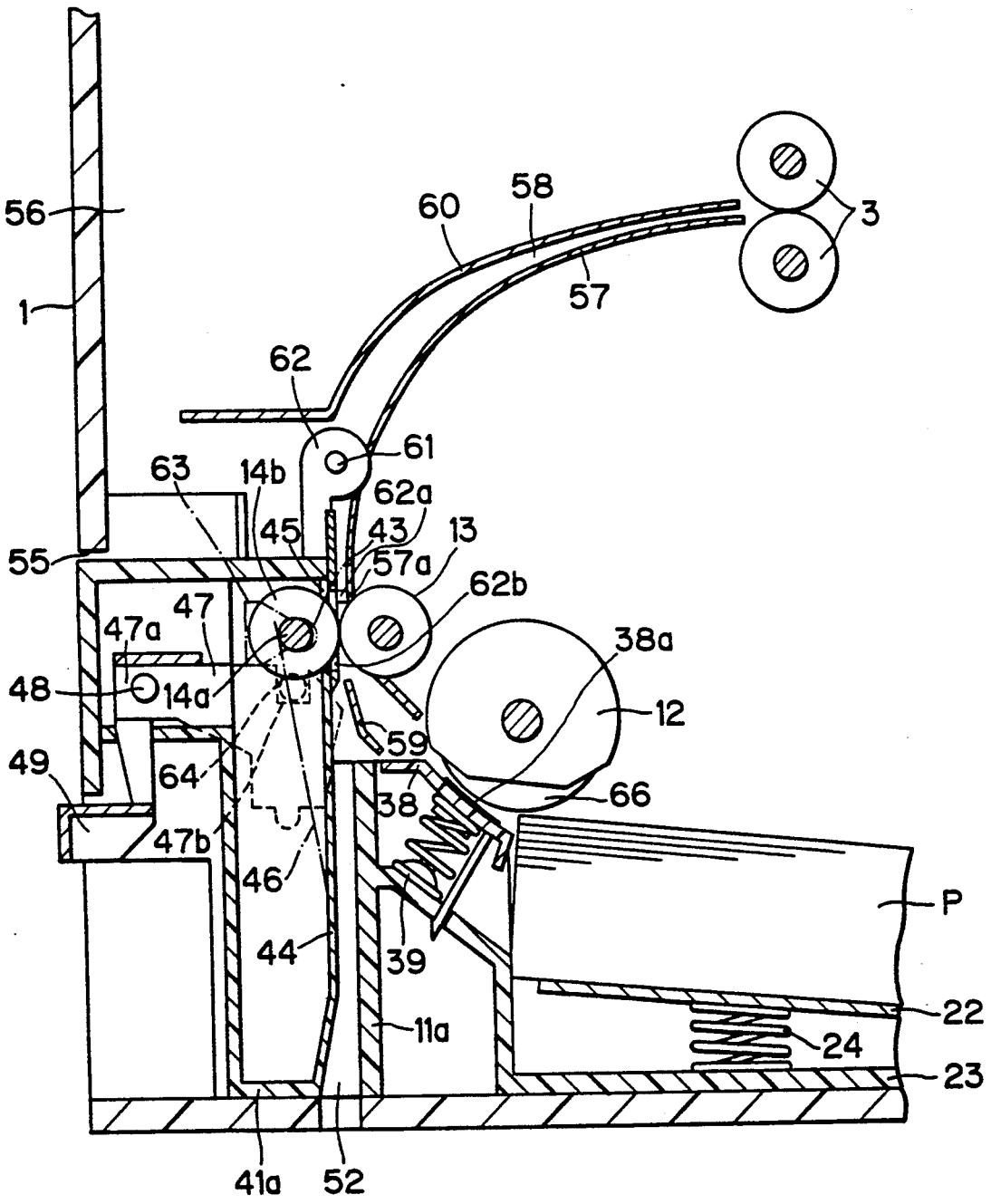
FIG. 8 is a partial cross-sectional view showing a state in which the sheet cassette is attached to the laser printer.

As shown in FIG. 4, the sheet cassette 11 has a box shape sheet accommodating portion 21 for accommodating therein a stack of the sheets P. A lifter plate 22 is disposed within the accommodating portion 21. The lifter plate 22 has a rear end portion (right side in FIG. 4) pivotally supported to the accommodating portion. The sheets P are stacked on the lifter plate 22. As shown in FIG. 8, a coil spring 24 is interposed between the lifter plate 22 and a bottom plate 23 of the accommodating portion 21. Thus, the lifter plate 22 is normally urged upwardly by the biasing force of the coil spring 24.

Each front portion of side walls 25 of the sheet cassette 11 is formed with an opening 26. On the other hand, a front portion of the lifter plate 22 is provided with laterally extending extensions 22*a* extending through the openings 26.

Figure 9:
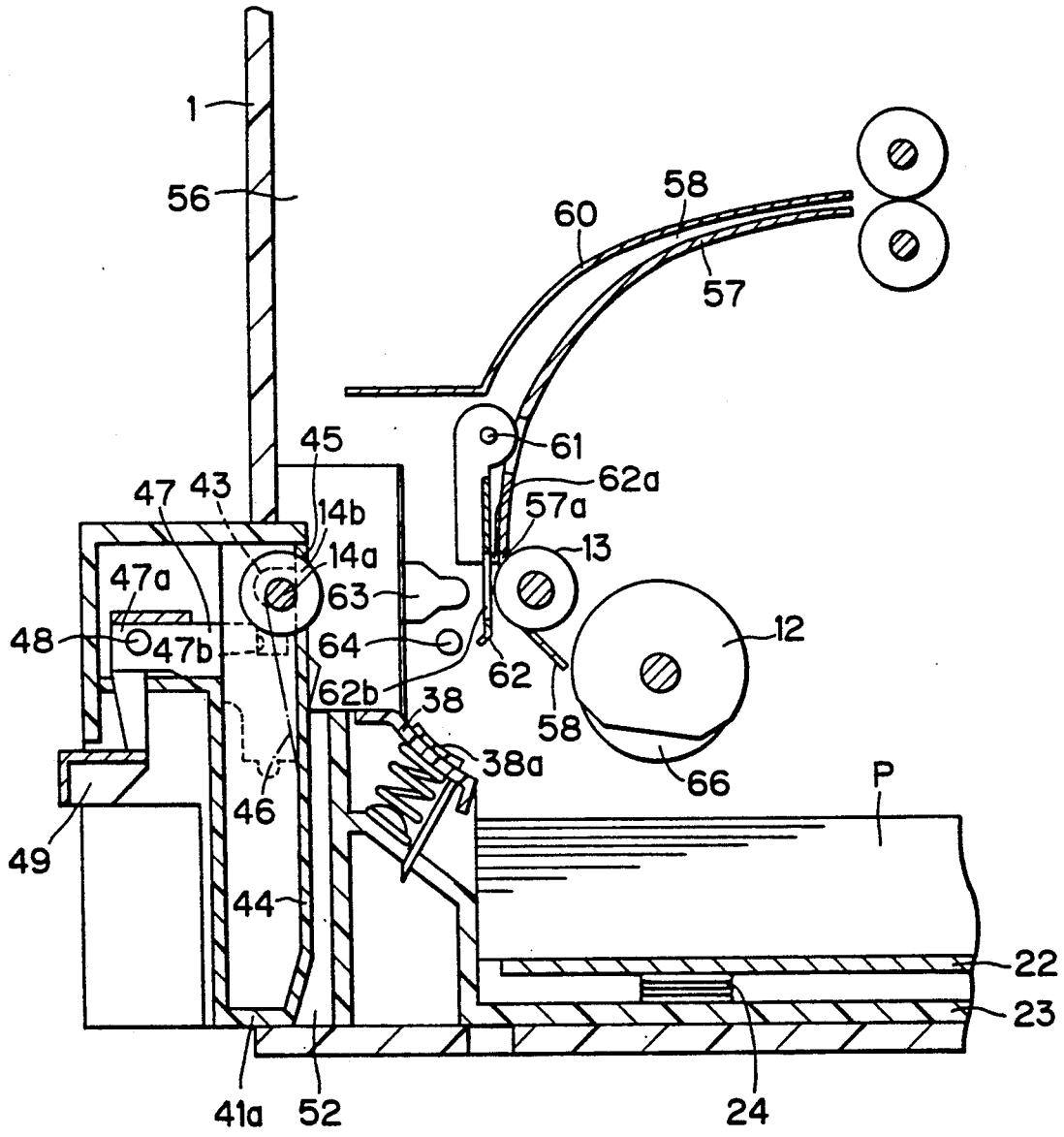
FIG. 9 is a partial cross-sectional view showing a state in which the sheet cassette is detached from the laser printer.

A stop member 27 is disposed at the side wall 25 at a position adjacent the opening 26. The stop member 27 has an upper portion provided with a projection 27*a* for pivotally moving the stop member about the projection 27*a*. Further, a notched portion 27*b* is formed at a lower rear portion of the stop member 27. The notched portion 27*b* is engageable with the extension portion 22*a* of the lifter plate 22 when the latter is pushed downwardly toward the bottom plate 23. By the engagement between the notched portion 27*b* and the extension portion 22*a*, the lifter plate 22 can maintain a lowermost position as shown in FIG. 9 against the biasing force of the coil spring 24.

At a front upper end portion of the stop member 27, a spring portion 27*c* extending frontwardly is integrally provided. One end of the spring portion 27*c* is engageable with an engagement wall 25*a* of the side wall 25. By the spring portion 27*c*, the stop member 27 is urged toward the extension portion 22*a* of the lifter plate 22. Because of the biasing force of the spring portion 27*c*, the notched portion 27*b* and the extension portion 22*a* can maintain engagement therebetween.

At a front lower end portion of the stop member 27, a projection 27*d* is integrally provided. The projection 27*d* projects laterally of the sheet cassette. The projection 27*d* laterally extends through a cut-out portion of the side wall 25 for engagement with a protruded portion 65 (see FIG. 3, and described later) when the sheet cassette 11 is assembled in the main frame 1 of the laser printer LP in order to disengage the notched portion 27*b* of the stop member 27 from extension portion 22*a* of the lifter plate 22.

A pair of sheet guides 30, 31 are provided movably in the lateral or width wise direction of the sheet P in the sheet accommodating portion 21. A co-actuation mechanism (not shown) is provided between the two sheet guides 30, 31 for automatically moving one of the sheet guides 30, 31 toward the remaining sheet guide 31 or 30 if the remaining sheet guide is moved toward the one of the sheet guides, and for automatically moving one of the sheet guides 30, 31 in a direction away from the remaining sheet guide 31 or 30, if the remaining sheet guide is moved away from the one of the sheet guides.

The sheet guides 30, 31 have guide surfaces 32 extending in parallel with a supplying direction of the sheet P. Each side edges of the stacked sheets P are abuttable on the guide surfaces 32 for regulating positions of the stacked sheets P. The guide surfaces 32 also serve to guide the travel of the sheet P which is delivered from the sheet cassette by means of the supply roller 12.

Figure 6:
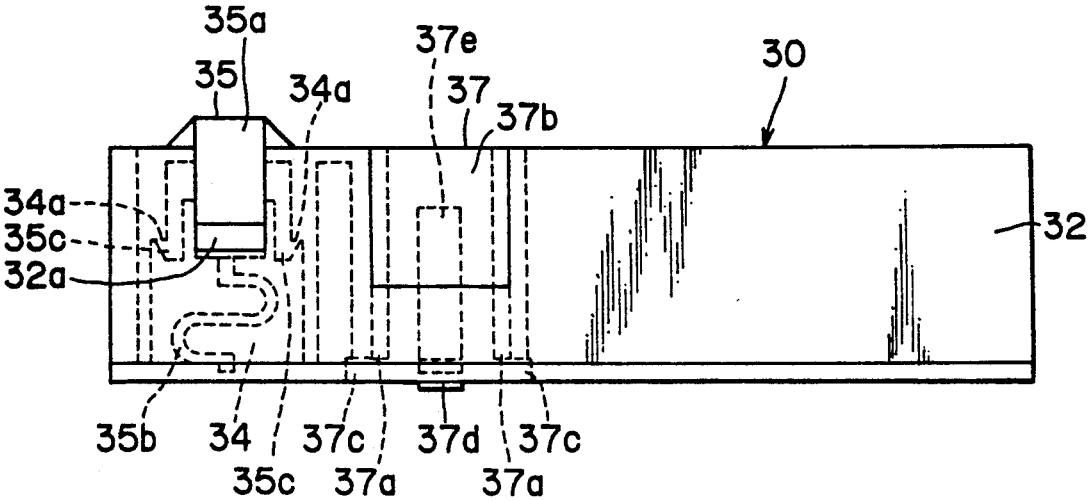
FIG. 6 is a side view showing the sheet cassette.
Figure 7:
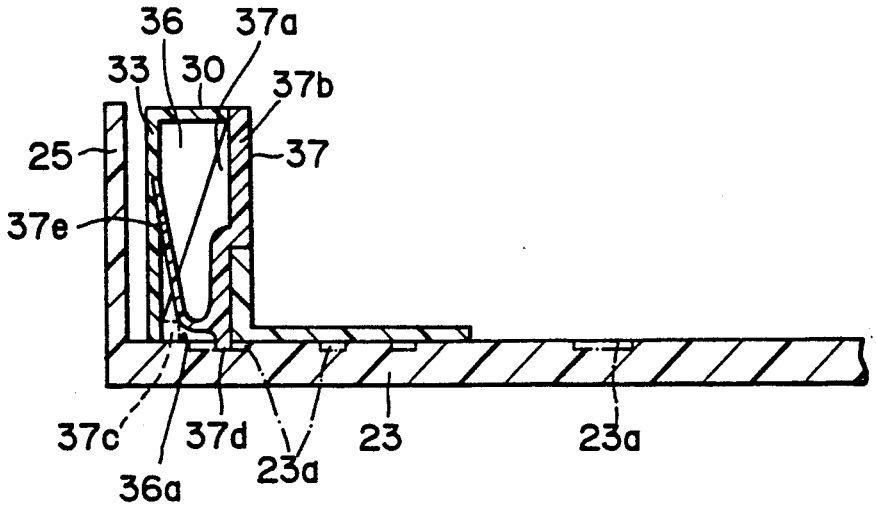
FIG. 7 is a cross-sectional view partly showing the sheet cassette.

As shown in FIGS. 6 and 7, the sheet guide 30 has a box-like portion 33 at a front portion thereof and at a side confronting the side wall 25 of the sheet accommodating portion 21. Within the box-like portion 33 and at a front portion thereof, a recessed portion 34 is formed. The recessed portion 34 has an upper narrow part and a lower wide part sectioned by a stepped portion 34*a* whose height is approximately the half of the height of the box-like portion. A vertically movable sub-guide 35 is accommodated within the recessed portion 34.

The sub-guide 35 has a sub-guide surface 35*a*. A cut out portion 32*a* is formed at the guide surface 32. The cut out portion 32*a* is located in a range from an upper edge of the guide surface 32 to a half height position thereof, and the sub-guide surface 35*a* is positioned within the cut out portion 32*a* and is flush with the guide surface 32.

Figure 10:
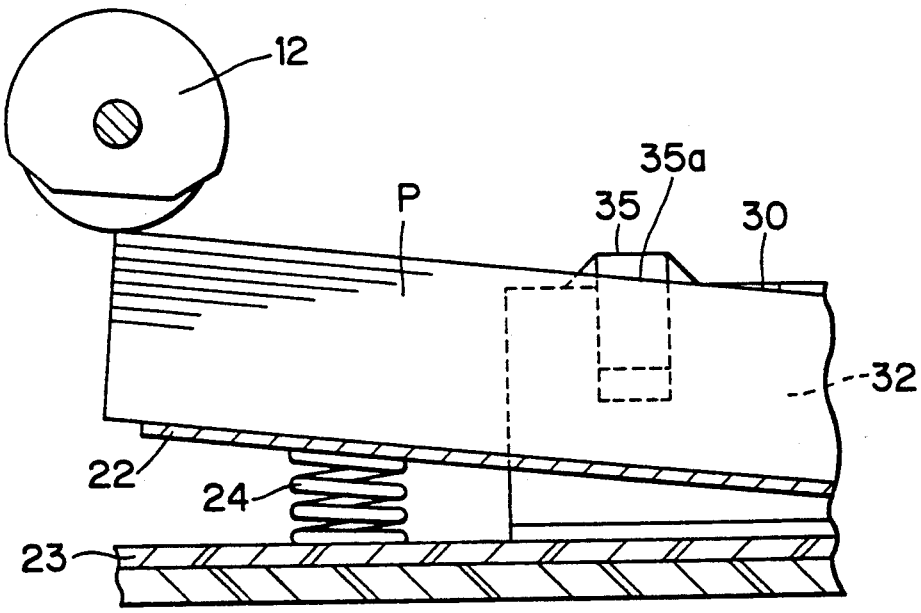
FIG. 10 is a view showing a sheet supplying roller and ambient components in a state where the sheet cassette is attached to the laser printer.

At a lower portion of the sub-guide 35, a spring portion 35*b* having S-shape is disposed. One end of the spring portion 35*b* is engaged with a bottom surface of the box-like portion 33. By the spring portion 35*b*, the subguide 35 is urged upwardly. The sub-guide 35 is provided with a pawl portion 35*c* engageable with the stepped portion 34*a*. Because of the biasing force of the spring portion 34*b*, the pawl portion 35*c* of the sub-guide 35 maintains engagement with the stepped portion 34*a* of the recessed portion 34. With this state, a top portion of the sub-guide 35 is protruded from the upper edge of the box-like member 33. The sub-guide surface 35*a* has a part corresponding to the protruded part. The protruded part of the sub-guide surface 35*a* is adapted for guiding the sheet P instead of the guide surface 32 when the stacked sheets P are partly lifted by the lifter plate to a position exceeding the guide surface 32 of the sheet guide 30 as shown in FIG. 10.

Incidentally, the other sheet guide 31 has the identical vertically movable sub-guide 35. Upper portions of these sub-guides 35 are normally protruded from the upper edge of the sheet guides 31.

At the right side sheet guide 30, a through hole 36 (FIG. 7) extending in a vertical direction is formed at a rear portion of the box-like portion 33. Within the through hole 36, a locking member 37 is provided. The locking member 37 includes two side plates 37*a* having right-angled triangular shape and an operating portion 37*b* connecting together the two side plates 37*a*.

The operating portion 37*b* of the locking member 37 has upper half portion protruded toward the guide surface 32 and a lower half portion positioned inward of the box-like member, so that a stepped portion is provided at a boundary between the upper and lower half portions. A part of the guide surface 32 is cut away at a position corresponding to the upper half portion, so that the operating portion 37*b* is fitted with the cut away portion. Incidentally, the upper half portion of the operating portion 37 is flush with the guide surface 32 when the operating portion is fitted with the cut away portion.

The side plate 37*a* of the locking member 37 is provided with a laterally extending projection 37*c*. Further a recessed portion 36*a* is defined at a wall of the box like portion 33. The projection 37*c* of the locking member 37 is insertable into the recessed portion 36*a*. Thus, the locking member 37 is pivotally movable about the projection 37*c*.

As shown in FIG. 7, an engagement projection 37*d* is provided at a lower end of the operating portion 37*b* of the locking member 37. The engagement projection 37*d* has one lateral side face, which confronts the right side wall 25, extending vertically, and another lateral side face, which faces a central portion of the sheet accommodating portion 21, extending obliquely. (In FIG. 7, a left side face of the projection 37*d* extends vertically, and a right side face thereof extends obliquely.) On the other hand, at position on the bottom plate of the sheet accommodating portion 21 and at a position confronting the engagement projection 37*d*, engagement grooves 23*a* are formed. The engagement grooves 23*a* extends in the sheet supplying direction, and spaced with each other corresponding to several widths of sheets. Each of the engagement grooves 23*a* has a one lateral side, which confronts the right side wall 25, extending vertically, and another lateral side face, which faces the central portion of the sheet accommodating portion 21, extending obliquely.

With the arrangement of the engagement projection 37*d* and the engagement grooves 23*a*, the sheet guide 30 is easily movable toward the opposite sheet guide 31, but cannot be movable in a direction away from the sheet guide 31.

The operating portion 37*b* of the locking member 37 is integrally provided with a spring portion 37*e* having one end engaged with an inner surface of the box-like portion 33 for urging the operating portion 37*b* toward the guide surface 32.

At a front center portion of the sheet accommodating portion 21, a separation member 38 (FIGS. 4, 8 and 9) is provided for supplying only an uppermost sheet P of the stacked sheets in the accommodating portion 21 in co-operation with the sheet supply roller 12. As shown in FIGS. 8 and 9, the separation member 38 is provided movably in a direction toward the supplying roller 12. Further, a coil spring 39 is provided between the separation member 38 and an inner wall 11*a* of the sheet cassette 11. Therefore, the separation member 38 is normally urged toward the supplying roller 12. Incidentally, a rubber plate 38*a* is attached to a separation member surface confronting the sheet supplying roller 12.

A grip portion 41 is provided at a front portion of the sheet accommodating portion 21 of the sheet cassette 11. Within the grip portion 41, the above described second feed roller 14 is disposed. The second feed roller 14 includes a shaft 14*a* and two rollers 14*b* mounted on the shaft 14*a* and spaced away from each other by a predetermined distance. Both ends of the shaft 14*a* extends laterally outwardly of the grip portion 41 through openings 43 formed at lateral sides of recesses 42 (FIG. 4) positioned at lateral sides of the grip portion 41 and at confronting sides of the sheet accommodating portion 21. The shaft 14*a* is movable within the openings 43. The grip portion 41 has a rear wall 44 at which slots 45 are formed for allowing the parts of the rollers 14*b* to be protruded therethrough. A leaf spring 46 is disposed in the grip portion 41, and the leaf spring 46 has one end contactable with the shaft 14*a* and another end fixed to the inner wall of the grip portion 41 for urging the rollers 14*b* toward the slots 45.

A pair of locking plates 47 are disposed at a position adjacent to the both lateral side portions of the grip portion 41. That is, the recesses 42 at the lateral side portions have sides confronting the sheet accommodating portion 21, and slots 42*a* (FIG. 4) are formed at the confronted sides. The locking plates 47 extend through the slots 42*a* out of the grip portion 41. The locking plates 47 have base portions 47*a* supported by supporting pins 48 extending laterally inwardly from side walls in the grip portion 41, so that the locking plates 47 are pivotable about the supporting pins 48.

Each of the base portions 47*a* of the locking plate 47 is connected to each operation member 49 for rotating the locking plates 47 in a clockwise direction in FIGS. 8 and 9. Parts of the operation members 49 extend outwardly of the grip portion 41. Further, a coil spring 50 is interposed in the recessed portion 42 of the grip portion 41 and between a bottom wall 41*a* of the grip portion 41 and a lower end of the locking plate 47 for normally urging the locking plate 47 in a counterclockwise direction in these Figures. Furthermore, the exposed portion of the locking plate 47 is formed with an engaging groove 47*b* for engagement with a positioning pin 64 described later.

As best shown in FIG. 8, a sheet passage 52 is defined between the sheet accommodating portion 21 and the grip portion 41 for delivering a sheet fed from another sheet feed mechanism connected to a lower end portion of the main frame 1 toward the feed rollers 12 and 13.

A cassette insertion slot 55 is formed in the main frame 1 for assembly of the sheet cassette 11 thus constructed. Lower portions of pair of side plates 56 which support the sheet supplying roller 12 and the first feed roller 13 are visible through the insertion slot 55, these side plates 56 being visible at the upper lateral end portions of the slot 55.

The pair of side plates 56 rotatably support the above described resist rollers 3, the first feed roller 13 and the sheet supplying roller 12 these being arranged in order in a downward direction. Further, a guide plate 57 bridging between the sheet supplying roller 12 and the resist rollers 3 is fixedly secured between the side plates 56 for providing a sheet feed passage 58. At a position below the guide plate 57, a perforated slot 57*a* is formed for allowing a part of the first feed roller 13 to be protruded into the sheet feed passage 58 through the slot 57*a*.

A guide plate 59 is fixedly secured between the side plates 56 at a position between the sheet supplying roller 12 and the first feed roller 13 and in confronting relation to the guide plate 57 by a predetermined distance in order to guide travel of the sheet P delivered by the sheet supplying roller 12 toward a portion between the feed rollers 13 and 14 in co-operation with the guide plate 57. Further, a guide plate 60 is fixedly secured to the side plates 56 at a position between the first feed roller 13 and the resist roller 3 in confronting relation to the guide plate 57 by a predetermined distance for defining a sheet passage 58 in co-operation with the guide plate 57.

The guide plate 60 has a cut away portion at a position immediately above the second feed roller 14. Further, at a position adjacent the lower end of the guide plate 60, a pin 61 extends between the side plates 56 for pivotally supporting a movable guide plate 62. The movable guide plate 62 serves to define a part of the sheet feed passage 58 instead of the guide plate 60. At both lateral edge portions of the movable guide plate 62, projections 62*a* extend toward the guide plate 57. Because of own weight of the movable guide plate 62, tip ends of the projections 62*a* abut the guide plate 57. Thus, a predetermined space is defined between the guide plate 57 and the movable guide plate 62 because of the projections 62*a*. Incidentally, since the projections 62*a* are positioned at lateral edges of the movable guide plate 62, the projections do not interfere with the sheet P fed along the sheet feed passage 58.

The movable guide plate 62 has a portion confronting the first feed roller 13. At the confronting portion of the movable guide plate 62, an opening 62*b* is formed, so that a part of the second feed roller 14 protrudes through the opening 62*b* and brings into contact with the first feed roller 13, when the sheet cassette 11 is inserted into the insertion slot 55.

As shown in FIGS. 8 and 9, guide portions 63 are provided at the side walls 56 at a position leftwardly relative to a supporting position of the first feed roller 13 for guiding the shaft 14*a* of the second feed roller 14 along the guide portions 63, to thereby permit the second feed roller 14 to be accurately confronted with the first feed roller 13. In accordance with the inserting operation of the sheet cassette 11 through the insertion slot 55, the end portions of the shaft 13*a* laterally outwardly extending from the recessed portions 42 of the grip portion 41 are entered into the guide portion 63, so that the second feed roller 14 can undergo positioning to have an accurate confronting position relative to the first feed roller 13.

At a lower portion of the guide portion 63, positioning pins 64 extend from the side walls 56 in alignment with each other. When the sheet cassette 11 is inserted through the insertion slot 55, the engagement grooves 47*b* of the locking plate 47 are brought into engagement with the positioning pins 64 as best shown in FIG. 8, to thereby fix the sheet cassette 11 at a given position.

At both lateral sides and at lower portion of the insertion slot 55, a pair of projected portions 65 are provided. When the sheet cassette 11 is inserted through the insertion slot 55, each projection 27*d* of the stop member 27 is brought into engagement with the projected portions 65, so that the extension portion 22*a* of the lifter plate 22 is disengaged from the notched portion 27*d* of the stop member 27. Accordingly, the lifter plate 22 is pivotally moved toward the sheet supplying roller 12 by the biasing force of the coil spring 24.

Figure 3:
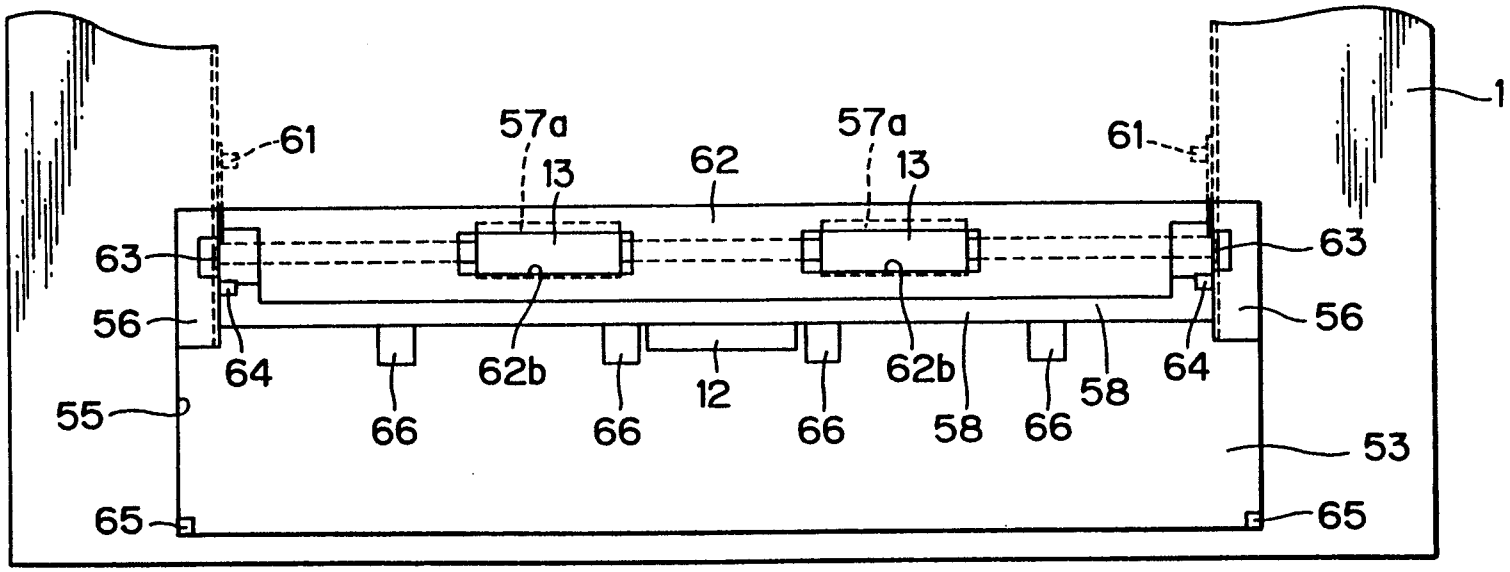
FIG. 3 is a front view showing an insertion slot and ambient portion of the laser printer for installation of a sheet cassette.

As shown in FIG. 3, the sheet supplying roller 12 is positioned at a center portion of its support shaft. The sheet supplying roller 12 has a irregular shape in which a part of a cylindrical configuration is cut away. First pair of collars 66 are disposed on the support shaft at positions adjacent the both ends of the sheet supplying roller 12. Further, another collars are mounted on the support shaft, each being positioned between the side wall 56 and the first collar 66. These four collars 66 are provided rotatably about the support shaft, whereas displacement of these collars in an axial direction of the support shaft is prevented. Further, a radius of the collars 66 is slightly smaller than that of the arcuate portion of the sheet supplying roller 12. These collars 66 are adapted for preventing the sheet P from being fed diagonally in case of the sheet delivery by the sheet supplying roller 12.

Next, operation of the laser printer LP, thus constructed, will be described.

Prior to the printing operation, in case where the sheets P must be supplemented or the sheets must be replaced by another kind of sheets having another size, an operator grips the grip portion 41 and the operating member 49 so as to rotate the operating member 49 in a clockwise direction in FIG. 8. Consequently, the locking plate 47 is angularly rotated in the clockwise direction, so that the engagement groove 47*a* of the locking plate 47 is disengaged from the positioning pin 64 protruded from the side plate 56. With this state, the operator can pull out the sheet cassette 11.

For supplementing sheets P in the sheet cassette 11 which has been pulled out, the front end portion of the lifter plate 22 lifted by the coil spring 24 is manually depressed downwardly, so that the extension portion 22*a* of the lifter plate 22 is brought into engagement with notched portion 27*b* of the stop member 27. Since the stop member 27 is urged toward the extension portion 22*a* by the spring portion 27*c*, the engagement between the extension portion 22*a* and the notched portion 27*b* can be maintained, to thereby maintain the lower depressing position of the lifter plate 22 as shown in FIG. 9. With this state, the operator supplements sheets P.

If sheets having size different from that of the sheets P already stored in the pulled out sheet cassette 11 are to be used and accommodated in the cassette 11, the already stored sheets P are removed, and maintains downward position of the lifter plate 22. Then, the sheet guide 30 is moved dependent on a size of the newly stored sheets.

In this case, if the new sheets to be accommodated have size smaller than that of the already accommodated sheets, the new sheets are firstly placed on the center portion of the sheet accommodating portion 21 of the sheet cassette 11. Then, the sheet guide 30 are laterally depressed toward the center until the guide surface 32 abuts side edges of the newly stacked sheets. In this instance, the slanting surface of the locking projection 37*d* of the locking member 37 disposed at the sheet guide 30 is slidingly moved with respect to the slanting surface of the engagement groove 23*a*. Therefore, the locking member 37 is angularly moved in the counterclockwise direction in FIG. 7. Thus, the locking projection 37*d* is brought into locking engagement with a neighboring engagement groove 23*a*. Since the movement of the sheet guide 30 toward the opposite sheet guide 31 can be attained easily by the locking projection 37*d* and the engagement groove 23*a*, the position of the sheet guide 30 can be changed easily without manipulation to the locking member 37 for the purpose of releasing engagement between the locking projection 37*d* and the engagement groove 23*a*.

On the other hand, if the newly accommodating sheets have size greater than that of the already accommodated sheets, the operator depresses the operating portion 37*b* of the locking member 37 of the sheet guide 30 toward the side wall 25 of the sheet cassette 11. By this operation, the locking member 37 is angularly rotated about the projection 37*c* in a counterclockwise direction, so that the locking projection 37*d* is moved away from the engagement groove 23*a* of the sheet accommodating portion 21, to thereby provide disengagement of the locking projection 37*d* from the engagement groove 23*a*. With this state, the operator depresses the sheet guide 30 toward the side wall 25, so that a distance between the sheet guides 30 and 31 is increased.

The operating portion 37*b* is continued to be depressed so as to further move the sheet guide 30 toward the side wall 25 until the distance between the sheet guides 30 and 31 becomes greater than a width of the newly accommodating sheets. If the distance between the sheet guides 30 and 31 becomes greater than the sheet width, the movement of the sheet guide 30 is stopped, and the new sheets are placed on the lifter plate 22. Then, as described above, the sheet guide 30 is depressed toward the center of the sheet cassette 11 until the guide surface 32 abuts the side edges of the sheets.

The sheet cassette 11 in which the sheets P are accommodated in the sheet accommodating portion 21 is inserted through the insertion slot 55 of the laser printer LP in such a manner that a tail end of the cassette 11 is first inserted thereinto. During this installation, the sub-guides 35 upwardly protruded from the upper edges of the sheet guides 30 and 31 may occasionally abut collars 66 dependent on the position of the sheet guides 30, 31. However, since the sub-guides 35 are vertically movable, the sub-guides 35 are moved downwardly into the sheet guides 30 and 31 when they abut the collars 66. Therefore, the operator can insert the sheet cassette 11 through the insertion slot 55 without any special attention to the position of the sheet guides 30, 31.

If the sheet cassette 11 is further inserted through the insertion slot 55 from a state shown in FIG. 9, the projection 27*d* of the stop member 27 of the sheet cassette 11 is brought into engagement with the projection 65 positioned within the insertion slot 55. If the inserting movement is continued, the projection 65 urges the stop member 27 against the biasing force of the spring portion 27*c*, and the stop member 27 is angularly rotated about the projected portion 27*a* in a clockwise direction in FIG. 4. Thus, the notched portion 27*b* of the stop member 27 is disengaged from the extension portion 22*a* of the lifter plate 22. Accordingly, the lifter plate 22 can be angularly moved upwardly in the clockwise direction in FIG. 4 because of the biasing force of the coil spring 24 about the rear portion of the lifter plate 22, so that the uppermost sheet P of the sheet stack accommodated in the sheet accommodating portion 21 is brought into contact with the outer peripheral surfaces of the collars positioned adjacent to the sheet supplying roller 12.

If the sheet P is in contact with the collars 66 by the angular rotational movement of the lifter plate 22, a portion of the sheet P in the vicinity of the collars 66 is positioned above the upper edges of the sheet guides 30, 31 as shown in FIG. 10. With this state, if the sheet cassette 11 is further inserted through the insertion slot 55, the upper portion of the stacked sheets P may be misaligned from each other. However, according to the illustrated embodiment, the sheet cassette 11 has the sheet guides 30, 31 provided with the sub-guides 35 whose guide surfaces 35*a* can still guide the side edges of the sheets P. Thus, it is possible to avoid misalignment of the upper portion of the sheets.

If the sheet cassette 11 is further inserted through the insertion slot 55 from the state shown in FIG. 9, the locking plate 47 of the sheet cassette 11 is brought into contact with the positioning pin 64. By this contact, the locking plate 47 is angularly rotated in a clockwise direction in FIG. 9. If the sheet cassette 11 is further inserted, the engagement groove 47*b* of the locking plate 47 is brought into engagement with the positioning pin 64. By this engagement, the installation of the sheet cassette 11 into the main frame 1 of the laser printer LP is completed. Simultaneously, the both ends of the shaft 14*a* of the second feed roller 14 is moved into the guide portion 63, so that the second feed roller 14 is brought to a position in confrontation with the first feed roller 13 through the opening 62*b* of the movable guide plate 62. Moreover, the second feed roller 14 is brought into contact with the first feed roller 13 projected through the slot 57*a* of the guide plate 57. (see FIG. 8).

In the cassette installation state shown in FIG. 8, the second feed roller 14 is in contact with the first feed roller 13, and the shaft 14*a* of the second feed roller 14 is urged toward the first feed roller 13 by the leaf spring 46. Therefore, the sheet cassette 11 is urged in a direction to detach the cassette out of the insertion slot 55 due to the reaction force from the first feed roller 13. However, since the engagement groove 47*b* of the locking plate 47 is engaged with the positioning pin 64, the sheet cassette 11 can undergo positioning at the engagement position therebetween.

Will be described operation of the laser printer LP assembled with the sheet cassette 11 in a manner described above.

As shown in FIG. 8, in case where the sheet cassette 11 is assembled in the laser printer LP, the irregularly configured portion of the sheet supplying roller 12 is facing with the uppermost sheet P of the sheet stack stored in the sheet cassette 11. If print command signal together with print data are outputted from a host computer (not shown) connected to the laser printer LP, the laser printer LP starts printing operation in accordance with the outputted print data.

In this printing operation, the sheet supplying roller 12 is rotated in a clockwise direction in FIG. 8. Therefore, the cylindrical portion of the sheet supplying roller 12 is in contact with the uppermost sheet P for feeding the sheet P toward the first and second feed rollers 13 and 14. During this feeding, even if two or three sheets are simultaneously fed by the sheet supplying roller 12, feeding of the sheets other than the uppermost sheet is restrained by the rubber plate 38*a* attached to the separation member 38, so that only the uppermost sheet can be fed. Further, during this feeding operation, the portion of the sheet P at a position adjacent the sheet supplying roller 12 is positioned above the upper edges of the sheet guides 30, 31. Therefore, the sheet may not be subjected to accurate guiding by the guide surface 32 of the sheet guides 30, 31 in the sheet feeding direction. Thus, there is a probability that the sheet may be diagonally fed with respect to the sheet feeding direction. However, in the illustrated embodiment, since the sub-guides 35 extend from the upper edges of the sheet guides 30, 31, and since the guide surfaces 35*a* of the subguides 35 serve to guide the sheet at a position adjacent the sheet supplying roller 12 in the sheet feeding direction, diagonal feeding of the sheet P can be obviated.

The sheet P fed by the sheet supplying roller 12 passes between the guide plates 57 and 59 and reaches the first and the second feed rollers 13 and 14. A predetermined nipping pressure is established between these rollers 13 and 14 by the leaf spring 46. Therefore, these rollers 13 and 14 nip the sheet P therebetween, and the sheet P is directed toward the resist roller 3 by way of the sheet passage 58.

The sheet P passing through the sheet feed passage 58 by the feed rollers 13 and 14 passes between the guide plate 57 and the movable guide plate 62 and reaches the resist roller 3. The resist roller 3 is not rotated when the sheet P firstly reaches the roller 3. Thereafter, the resist roller 3 starts rotation in synchronism with the photosensitive drum 5. Upon rotation of the resist roller 3, the sheet P is fed toward the photosensitive drum 5, and the toner image formed on the photosensitive drum 5 is transferred onto the sheet P by the charger 4. The toner image is then fixed by the fixing unit (not shown), and the image carrying sheet is discharged onto the discharge tray 6.

If the sheet P cannot be fed during the printing operation, that is, if sheet jamming occurs, the jamming is detected by a sensor (not shown), and the printing operation is immediately stopped, and at the same time, the sheet jamming is displayed at the display portion 70*a* of the manipulation panel 70. Therefore, the operator can acknowledge the sheet jamming state, and manipulates the operating member 49 of the sheet cassette 11 for detaching the sheet cassette 11 from the laser printer LP. Consequently, the second feed roller 14 is moved away from the first feed roller 13. By angularly moving the movable guide plate 62 in the clockwise direction in FIG. 9, open space can be provided at the sheet feed passage 58 for facilitating removal of the jammed sheet.

As described above, according to the sheet cassette 11 of the present invention, the sub-guides 35 are provided which is protrudable from the upper edges of the sheet guides 30 and 31. Therefore, the sheet feed cassette of the present invention can prevent the sheet stacked in the cassette from diagonal feeding when the sheet is delivered out of the cassette, and even if the sheet is positioned above the sheet guides 30, 31.

Moreover, the sub-guides can be sunk into the sheet guides 30, 31. Therefore, it is unnecessary to draw special attention to the position of the sheet guide when the sheet cassette 11 is attached to the laser printer LP through the insertion slot 55.

Further, the laser printer LP according to the depicted embodiment is provided with the guide plates 57 and 62, which constitute the sheet feed passage 58, and the first feed roller 13 at the main body portion, and the second sheet feed roller 14 at the sheet cassette 11. Therefore, a predetermined fixed distance can be provided between the guide plate 57 and the movable guide plate 62. Accordingly, it is possible to reduce possibility of sheet jamming at the sheet feed passage 58. Further, even if sheet jamming occurs at the sheet feed passage 58, the first and second feed rollers 13 and 14 are moved away from each other by detaching the sheet cassette 11 from the laser printer LP, and the sheet feed passage 58 can be opened by pivotally moving the movable guide plate 62. As a result, jamming sheet can be easily removed. Moreover, in spite of the movable arrangement of the second feed roller 14 relative to the first feed roller 13, stable nipping pressure can be established therebetween because of the accurate positioning of the second feed roller 14 relative to the first feed roller 13 by the engagement between the pin 64 and the engagement groove 47*b* and between the guide portion 63 and the shaft 14*a* of the second feed roller 14. Accordingly, it becomes possible to restrain slippage of the sheet relative to the surfaces of the rollers 13 and 14, to thereby further avoid sheet jamming.

Further, in the sheet cassette 11 according to the illustrated embodiment, the sheet guide 30 can be moved toward the opposite sheet guide 31 without any manipulation to the locking member 37. Therefore, the sheet guide 30 can be easily displaced to a desired position in accordance with the size of the sheet P. Further, since the sheet guide 30 cannot be moved away from the opposite sheet guide 31 unless the locking member 37 is manipulated. Therefore, accidental displacement of the sheet guide 30 is avoidable.

While the invention has been described in detail and with reference to specific embodiment thereof, it would be apparent to those skilled in the art that various changes and modifications may be made therein without departing from the spirit and scope of the invention.

What is claimed is:

1. A sheet feed cassette used in an image forming apparatus for storing a stack of a plurality of sheets and for delivering each one of the sheets to a desired position in a sheet feeding direction, the cassette comprising:

a sheet guide unit having a guide surface for guiding movement of the sheet in the sheet feeding direction, lateral side edges of the sheet being abuttable on the guide surface, the sheet guide unit having an upper end;

a sub-guide unit vertically movably provided at the sheet guide unit so as to be protrudable to a position above the upper end of the sheet guide unit, the sub-guide unit having an auxiliary guide surface flush with the guide surface of the sheet guide unit for guiding movement, in the sheet feeding direction, of an upper portion of the sheet stack when the sub-guide unit protrudes upwardly from the sheet guide unit, the upper portion of the sheet stack being positioned above the upper end of the sheet guide unit.

2. The sheet feed cassette as claimed in claim 1, further comprising a bottom plate on which the sheet guide unit is positioned.

3. The sheet feed cassette as claimed in claim 2, wherein the sheet guide unit comprises:

a first guide member having a first guide surface in contact with one lateral side edge of the sheet stack; and a second guide member having a second guide surface in contact with another lateral side edge of the sheet stack, the first and second guide member being movable in a lateral direction perpendicular to the sheet feed direction for adjusting a lateral width defined therebetween in accordance with a size of the sheet stack.

4. The sheet feed cassette as claimed in claim 3, wherein the sub-guide unit comprises:

a first sub-guide member vertically movably provided at the first guide member, the first sub-guide member having a first sub-guide surface flush with the first guide surface; and a second sub-guide member vertically movably provided at the second guide member, the second sub-guide member having a second sub-guide surface flush with the second guide surface.

5. The sheet feed cassette as claimed in claim 4, wherein the sub-guide unit further comprises:

a first box-like member provided at a front and laterally outer portion of the first guide member, the first box like member defining an internal space in which a first stepped portion is provided, the front portion of the first guide member being formed with a first cut away portion with which the first sub-guide member is slidably and vertically movably fitted; and a second box-like member provided at a front and laterally outer portion of the second guide member, the second box like member defining an internal space in which a second stepped portion is provided, the front portion of the second guide member being formed with a second cut away portion with which the second sub-guide member is slidably and vertically movably fitted.

6. The sheet feed cassette as claimed in claim 5, wherein the sub-guide unit further comprises:

a first engagement member engageable with the first stepped portion and connected to the first sub-guide member;

a first biasing means for urging the first sub-guide member upwardly, upward movement of the first sub-guide member being restrained by the abutment between the first engagement member and the first stepped portion, a second engagement member engageable with the second stepped portion and connected to the second sub-guide member; and a second biasing means for urging the second sub-guide member upwardly, upward movement of the second sub-guide member being restrained by the abutment between the second engagement member and the second stepped portion.

7. The sheet feed cassette as claimed in claim 2, further comprising:

side walls extending from lateral side edges of the bottom plate;

a lifter plate positioned on the bottom plate and having a rear pivot portion pivotally supported to the side walls; and a biasing member interposed between the bottom plate and the lifter plate for urging the lifter plate upwardly about the rear pivot portion for lifting the sheet stack upwardly, the upper portion of the sheet stack being positioned above the sheet guide unit by the upward pivot motion of the lifter plate.

8. The sheet feed cassette as claimed in claim 4, further comprising:

side walls extending from lateral side edges of the bottom plate;

a lifter plate positioned on the bottom plate and having a rear pivot portion pivotally supported to the side walls; and a biasing member interposed between the bottom plate and the lifter plate for urging the lifter plate upwardly about the rear pivot portion for lifting the sheet stack upwardly, the upper portion of the sheet stack being positioned above the first and second sheet guide members by the upward pivot motion of the lifter plate.

9. The sheet feed cassette as claimed in claim 1, further comprising side walls defining an external contour of the sheet feed cassette, the sheet guide unit being positioned within the side walls.

* * * * *